United States Patent [19]

Lagarelli et al.

[11] 4,117,979

[45] Oct. 3, 1978

[54] SHOWERHEAD

[75] Inventors: Carmen J. Lagarelli, Clayton; Charles J. Rudewick, Bear, both of Del.

[73] Assignee: Speakman Company, Wilmington, Del.

[21] Appl. No.: 787,971

[22] Filed: Apr. 15, 1977

[51] Int. Cl.[2] ..... B05B 1/08

[52] U.S. Cl. ..... 239/381; 239/441; 239/449

[58] Field of Search ..... 239/101, 102, 436–449, 239/460

[56] References Cited

U.S. PATENT DOCUMENTS

| | | | |
|---|---|---|---|
| 2,990,122 | 6/1961 | Blumberg et al. | 239/447 X |
| 3,373,942 | 3/1968 | Roman et al. | 239/460 |
| 3,929,287 | 12/1975 | Givler et al. | 239/447 X |
| 3,958,756 | 5/1976 | Trenary et al. | 239/444 X |
| 3,967,783 | 7/1976 | Halsted et al. | 239/447 X |

*Primary Examiner*—John J. Love
*Attorney, Agent, or Firm*—Connolly and Hutz

[57] ABSTRACT

A showerhead having an axially shiftable valve means to deliver either a continuous steady water spray or an intermittent or pulsating water spray. The head has a peripheral chamber through which water flows to provide the continuous steady shower spray and an inner chamber through which the water flows to provide the pulsating shower spray. The valve means travels only 0.200 inch in shifting from the pulsating spray position to the continuous spray position. In the pulsating spray position, the valve means blocks the path of water flow through the outer chamber by a seat-seal arrangement to direct the water into and through the inner chamber. In the continuous spray position, the valve means blocks the flow of water through the inner chamber by a bore seal arrangement to direct the water path through the peripheral chamber. The inner chamber includes turbine means rotated by the flow of water with means coupled to the turbine means which successively offers resistance to water flow through different portions of a spray face through which the flow of water is discharged from the head thereby creating an intermittent or pulsating flow. A rotatable hand controlled unit actuates the axially moving valve means and one may switch from a steady uniform spray to the pulsating spray by either continuing the rotation of the hand control in a 360° path or by reversing the hand control 180°.

10 Claims, 10 Drawing Figures

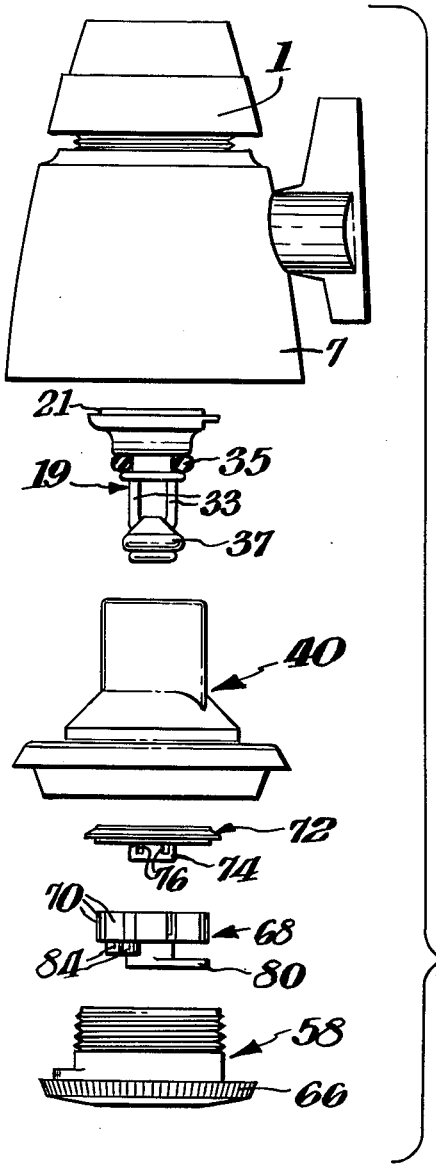
Fig. 1.
Fig. 2.
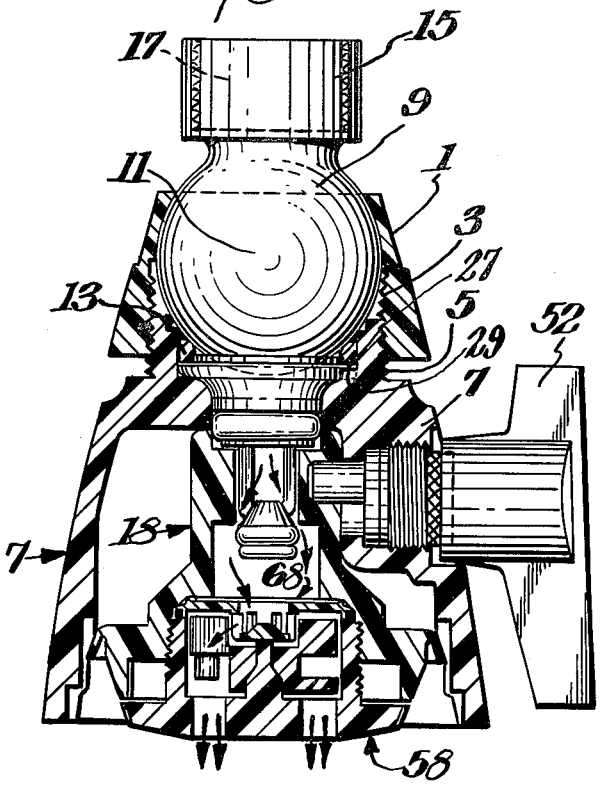
Fig. 3.
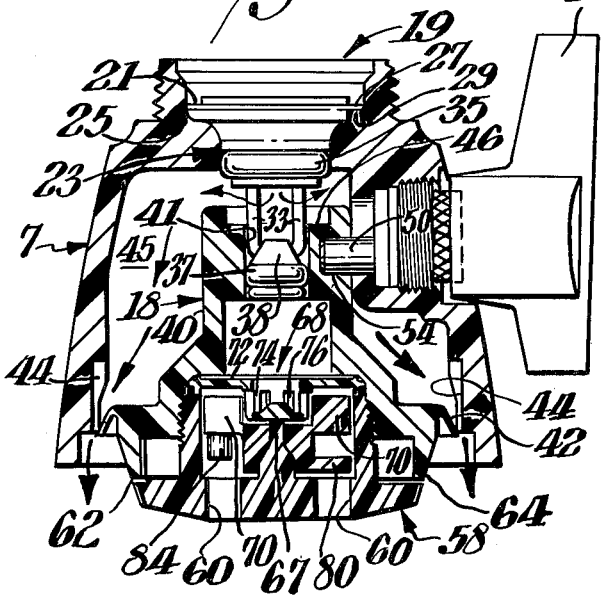

SHOWERHEAD

BACKGROUND OF INVENTION

Prior to the present invention, showerheads which emitted a pulsating stream of water were known, as were showerheads which emitted both a pulsating water spray and a continuous spray. In this respect one may refer to the following U.S. Pat. Nos.: 3,820,716; 2,878,066; 1,609,047; 2,701,563; 3,958,756; 3,734,410; 3,929,287; 3,801,019; 3,762,648; 3,920,185; 3,967,183; 3,485,451; 3,967,783; 3,568,716; 3,473,736.

A showerhead which can discharge upon selection of the user a continuous uniform spray of water or an intermittent pulsating spray is particularly desirable in that the continuous spray is usually satisfactory for most people, however, the intermittent spray is particularly desirable for persons who have just completed strenuous exercise or those persons who may be subjected to muscular aches and pains resulting from tension or high blood pressure. The pulsating spray stimulates blood circulation and relaxes the muscles particularly in the regions of the upper back and neck.

Needless to say, the above noted prior art devices as taught are operated and controlled through a variety of mechanical systems including many different types of valve means. However, none of the art discloses the valve means of the present invention for adjusting the flow of water from either a pulsating spray or a steady continuous spray to the opposite spray form. The spray can change from a pulsating form, to full flood form and then to a pinspray with only 0.200 inch travel of the valve means.

It is therefore an object of the present invention to provide an improved showerhead which will discharge either an intermittent pulsating spray of water or a continuous spray upon adjustment by the user.

Another object of the invention is to provide a head which has an adjusting handle which is external of the spray stream whereby the user does not have to get wet to adjust the selected stream.

Another object of the invention is to provide a showerhead of the above object which may be economically manufactured, which requires only limited maintenance, if any at all, and wherein replacement of parts is not necessary over an extended period of time and use.

A still further object is to provide a showerhead of the above objects which may be easily operated to adjust the sprays without reference to designated marked positions on the control means.

Yet another object is to provide the means for both regular and pulsating spray within the confines of a standard size showerhead thereby avoiding the bulk and aesthetic disadvantages of most dual showerheads now on the market (cf drawings in U.S. Pat. Nos. 3,967,783; 3,801,019; 3,929,287 and 3,958,756).

DETAILS OF THE INVENTION

A better understanding of the present invention can be found by reference to the accompanying drawings illustrating a preferred embodiment in which:

FIG. 1 is an exploded view of the showerhead.

FIG. 2 is a section of the showerhead showing the water path for the pulsating or intermittent spray.

FIG. 3 is a section of the showerhead showing the water path for the continuous spray.

Figure 4:
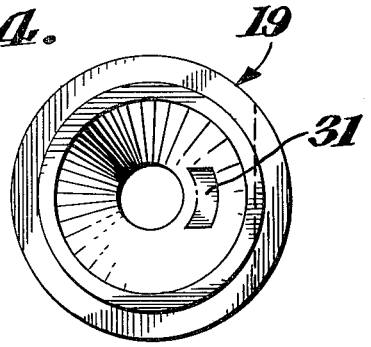
FIG. 4 is a top view of the plunger guide of the valve means shown in FIGS. 1–3.

As shown in FIG. 2 the spray head is formed of a retainer nut 1 preferably formed of chrome plated metal or suitable plastic material. The nut has inner threading 3 which mates with external threading 5 of a housing 7 for securing together the nut and the housing. The housing is preferably finished in the same material as the nut 1 having an aesthetically attractive appearance and shape similar to that shown in U.S. Pat. No. Des. 206,043. Supported within and extending through the top of the retainer nut 1 is a swivel fitting 9 provided with a ball member 11 adapted for frictional contact with a washer 13. The ball has integrally connected thereto a sleeve 15 which is internally threaded for securing the head to the usual shower water outlet. An inner passage 17 extends down through the sleeve 15 and ball 11 to communicate with the interior of the housing 7 as shown by the arrows.

As shown in FIGS. 1–3 as well as FIG. 4 there is positioned immediately below washer 13 a valve means 18 which includes a plunger guide member 19 preferably formed of plastic material such as Acetal. The washer 13 seats upon and extends above the recessed shoulder 21 of the guide member 19. The plunger guide 19 is trumpet shaped and the flared portion 23 fits within and is supported by a corresponding flared opening 25 extending through the top of the housing 7. A portion of the upper periphery of the plunger guide 19 is undercut to provide a shoulder 27 and a projection 29 which are used as registration or reference guides to assure the correct positioning of the guide within the housing 7 during assembly of the head. As shown in FIG. 4 which is a top view of the plunger guide 18, a small indent 31 is provided in the top surface of the guide and it is located directly over the shoulder 27. The indent 31 is used as a visual reference when looking down on the plunger guide to assure that the shoulder 27 and projection 29 are aligned with the showerhead is assembled.

Integral with the trumpet portion 23 of the plunger guide are depending and opposing legs 33. Just above the upper termination of the legs 33 there is supported around the circumference of the plunger guide a plastic or rubber O-ring seal 35 while just below the termination of legs 33 there is supported around the circumference of the plunger guide base 38 a rubber or plastic O-ring seal 37 which is much smaller in circumference than the O-ring 35. The base 38 has an inverted cone shape which tapers inwardly as it extends upwardly between the legs for a purpose to be explained later. The plunger guide 19 remains stationary during the adjusting of the spray from a pulsating to a continuous spray and vice-versa.

Positioned over the plunger guide shown in FIGS. 1–3 and forming the shiftable portion of the valve means 18 is a hollow face plate 40 preferably formed of filled polypropylene. The upper portion of the plate 40 is centrally bored as at 41 to form a sliding fit with the lower O-ring 37 of the plunger guide 19. The face plate 40 flares outwardly as it extends downwardly. The face plate at its lower end has a flexible, annular skirt 42 which contacts annularly disposed vertical water outlet grooves 44 at the lower end of the housing. As will be explained later, the axial movement of the face plate 40 will cause the skirt 42 to ride up or down over the grooves 44 to correspondingly adjust the continuous spray from full flood at the lowermost portion of the skirt 42 to pinspray at the uppermost position of the skirt 42. In effect, an annular cavity 45 is formed between the inner wall of the housing 7 and the wall of the face plate 40.

The face plate 40 is capable of being raised to its uppermost position as shown in FIG. 2 wherein shoulder 46 formed in the upper end of the face plate 40 seats upon O-ring 35 to seal off the path assumed by the water through the annular cavity 45 for the continuous spray and to confine the water path downwardly through the hollow plate 40 as shown by the arrows in FIG. 2. Because of the conical or tapered shape of the plunger guide base within the bore 41 of the face plate an annular opening is provided around the base and between the bore through which the water passes since the lower end of the bore is positioned above the lower O-ring 37.

In its lowermost position as shown in FIG. 3, the bore of the face plate moves down well below the lower O-ring 37 to seal off the bore to prevent water from passing down through the bore. As a consequence, the water is directed outwardly into and through the annular cavity 45 as shown by the arrows to subsequently pass through the grooves 44 as a continuous spray.

Figure 5:
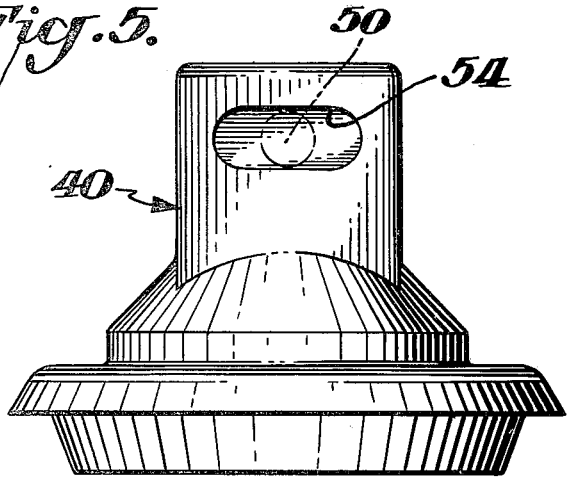
FIG. 5 is a detail illustrating the arrangement for axially moving the face plate of the valve means.
Figure 6:
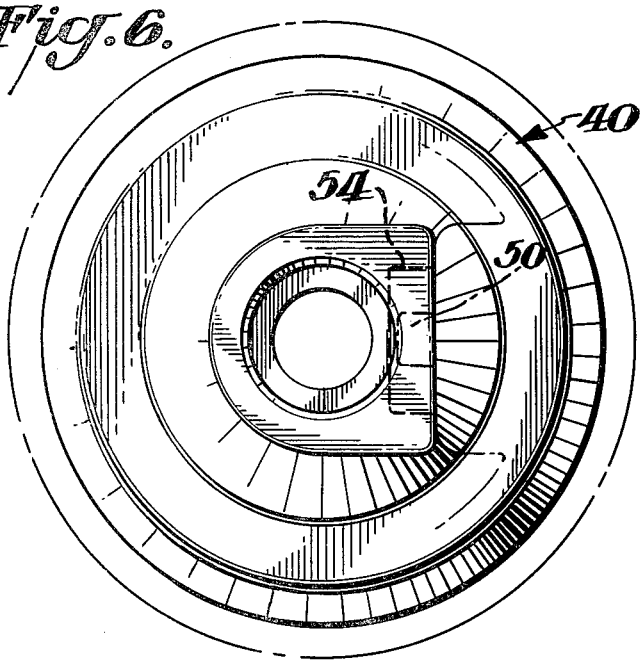
FIG. 6 is an enlarged sectional plan view which also illustrates the mechanism for raising and lowering the face plate.

As shown better in FIGS. 2, 5 and 6 the face plate is raised and lowered by a rotatable eccentric pin 50 which is in turn rotated by finger grip 52 extending through the housing 7. The pin 50 extends within an elongated slot 54 formed into the outer surface of the face plate 40 but not extending completely therethrough.

Figure 7:
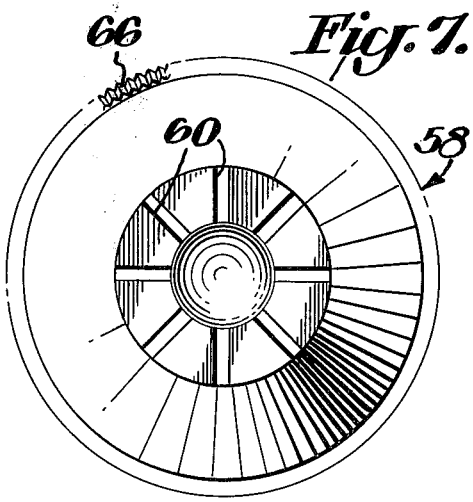
FIG. 7 is a bottom view of the spray face shown in FIGS. 1–3.

Threaded into the lower end of the face plate 40 is a spray face 58 which has water discharge slots 60 through which the pulsating sprays of water are emitted (also see FIG. 7). An annular flange 62 integral with the spray face 58 sits off 0.010–0.020 inch from the bottom edge of the depending annular skirt 64 of the plate 40. The periphery of the spray face 58 is serrated as at 66 to enable the assemblyman or user to thread the spray face 58 into the face plate 40. An axially extending bearing pin 67 is located internally and centrally of the spray face 58 and the spray face is preferably formed of acetal plastic material however other suitable plastic and metal materials may be used.

Figure 10:
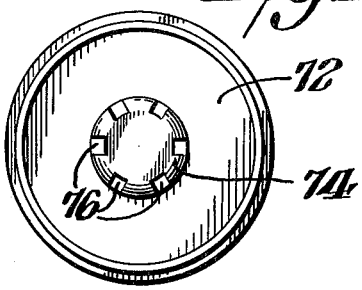
FIG. 10 is a bottom view of the diffuser plate shown in FIGS. 1–3.
Figure 8:
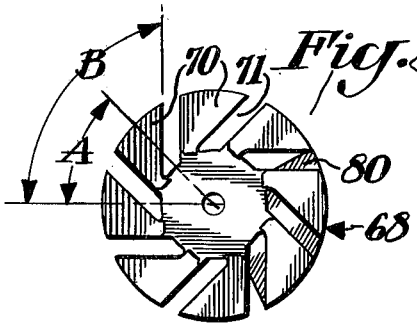
FIG. 8 is a top view of the turbine means.
Figure 9:
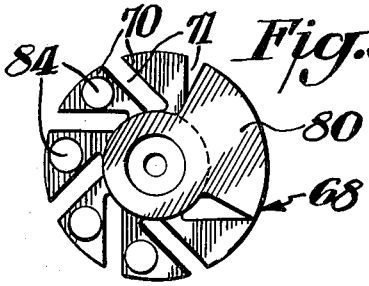
FIG. 9 is a bottom view of the turbine.

Supported on the bearing pin 66 is a turbine wheel 68, also shown in FIGS. 8 and 9, which has a series of radially extending blades 70. The center lines of the blades lie at approximately a 45° angle with respect to the horizontal axis as shown by angle A in FIG. 8. The leading face 71 of the blades is disposed at approximately a 45° angle to the center line of the blades as shown by angle B in FIG. 8. A diffuser plate 72, also shown in FIG. 10, is supported by the upper annular peripheral surface of the spray face 58 and has a depending central cage 74 which fits within the central cavity formed by the inner edges of the blades 70. A series of ports 76 extend through the cage wall and are disposed at an angle to the face 71 of the blades 70 whereby the water when passing into the diffuser plate 72 and through the ports 76 impinges upon the blade faces 71 to rotate the turbine wheel 68.

The turbine wheel 68 also includes as an integral fixed part thereof a sectoral blade 80 which extends radially of the turbine wheel and is positioned below the blades 70 in spaced relationship therewith. In a preferred construction the sectoral blade 80 overlies at any one time approximately one-fourth of the water discharge slots 60 in the spray face 58. As the sectoral blade 80 rotates, it successively interrupts the water flow passing downwardly from the turbine blades 70 and through different portions of the spray face to give a pulsating effect to the water being discharged through the spray face slots 60.

The turbine wheel also includes a series of balance posts 84 depending from the bottom of the blades 70 to prevent vibration and wobbling of the wheel during rotation. Preferably, the turbine wheel has eight blades and a post 84 depending from each of the four blades most opposite to the sectoral blade 80. As pointed out above, the described mechanism is all housed within a standard housing which has been on the market for some years, for instance, see U.S. Pat. No. Des. 206,043. Thus, cumbersome and unwieldy housing such as shown by the prior art can be eliminated.

Although the operation of the spray head is evident from the above description, it is noted that when the face plate 40 is in the lowered position the flow of water is blocked from entering the interior of the plunger leading to the turbine wheel. In this instance, the water passes outwardly through the annular cavity 45 as it enters the housing 7 and downwardly through the cutout slots 44 and the lower inner surface of the housing 7. When the face plate 40 is in the raised position the water passes into the interior of the plunger, through the diffuser plate into the turbine wheel and through the spray face outlet 60.

As the face plate 40 is lowered from its pulsating spray position to the continuous spray position the water flow passing through the annular cavity 45 of the housing 7 and through the cutout slots 44 adjusts from a pinpoint spray to a full flood spray. The reverse occurs as the face plate 40 is raised from its lower continuous spray position to its intermittent or pulsating spray position. Regardless of how much back pressure is created during the adjusting of the plunger there is always a flow of water through the spray head and discharge of water therefrom.

What is claimed is:

1. A showerhead which can be adjusted for delivering a continuous water spray or a pulsating water spray comprising a housing which is open at the bottom and has a passageway extending through the top, valve means which includes a plunger guide supported in the housing passageway and extending down into the housing interior and a hollow face plate open at both ends having an upper bore portion positioned around and supported by the plunger guide whereby an annular cavity is formed between the inner housing wall and the face plate wall, said face plate being capable of moving axially of the plunger guide, an opening in the top of said plunger guide through which water is received to be directed either through a face plate or the housing depending upon the axial position of the face plate, a seal supported by the upper portion of the guide, a seal supported by the lower portion of said guide, means for moving the face plate axially of said guide whereby when the face plate is raised to its uppermost position the upper end of the face plate seats against the upper guide seal to block off water flow passing through said annular cavity and to direct the flow downwardly through the bore section of the hollow face plate, and whereby when the face plate is lowered to its lowermost position the bore section of the face plate moves downwardly around the lower seal to block off water flow through the face plate whereby the water flow is directed through said annular cavity, a spray face member having slots attached to the bottom of the face plate for discharging water passing through the hollow face plate, a rotatable turbine wheel having blades positioned above and supported by the spray face member, a water diffuser plate positioned above the turbine wheel to direct water flow into said turbine wheel, said water diffuser plate having a central cage which fits within a cavity formed by the inner ends of the turbine wheel blades with ports in said cage through which water is discharged to the blades, and a sectoral blade integral with the turbine wheel spaced below said blades for intermittently offering resistance to water passing from the blades of the turbine wheel to the outlet slots in the spray face to deliver a pulsating water spray.

2. The showerhead of claim 1 wherein an annular series of water discharge slots are located around the lower end of the housing wall for discharging in a continuous spray said water flow when passing through said annular cavity.

3. The showerhead of claim 1 wherein the length of travel of the face plate is about 0.200 inch.

4. The showerhead of claim 1 wherein the center lines of the turbine wheel blades lie at approximately a 45° angle with respect to the horizontal axis of the wheel.

5. The showerhead of claim 4 wherein the turbine wheel blades have leading faces against which water impinges to rotate the blades, said leading faces being disposed at approximately a 45° angle to said center line of the blades.

6. The showerhead of claim 1 wherein the turbine wheel blades having depending balance posts integral therewith.

7. The showerhead of claim 6 wherein said posts depend from one half the number of blades of the turbine wheel.

8. The showerhead of claim 7 wherein the blades with said posts are those located most opposite to the sectoral blade.

9. The showerhead of claim 1 wherein the plunger guide includes a pair of opposed legs which connect said upper and lower portions of said guide, and the lower portion has the form of an inverted cone around which water flows into the water diffuser when the plunger is in the raised position.

10. The showerhead according to claim 1 wherein the means for moving the face plate axially of the guide includes an eccentric pin operable within an elongated indent in the wall of the face plate, and a rotatable handle connected with said pin, said uppermost and lowermost positions of the face plate being achieved by a 180° rotation of said blade.

* * * * *